United States Patent [19]

Tasma

[11] Patent Number: 4,479,839

[45] Date of Patent: Oct. 30, 1984

[54] LABELING MECHANISM

[75] Inventor: Gerald W. Tasma, Grand Rapids, Mich.

[73] Assignee: Grand Rapids Label Company, Grand Rapids, Mich.

[21] Appl. No.: 471,072

[22] Filed: Mar. 2, 1983

[51] Int. Cl.[3] ..... B65C 9/18

[52] U.S. Cl. ..... 156/249; 156/285; 156/361; 156/542; 226/68; 226/162

[58] Field of Search ..... 156/540–542, 156/247–249, 36, 584, 384, 571; 226/68, 162

[56] References Cited

U.S. PATENT DOCUMENTS

| | | | |
|---|---|---|---|
| 3,329,550 | 7/1967 | Kucheck | 156/584 X |
| 3,405,021 | 10/1968 | Marana | 156/361 |
| 3,619,324 | 11/1971 | Yosato et al. | 156/384 |
| 3,645,832 | 2/1972 | Sauer | 156/541 |
| 3,655,492 | 4/1972 | Burton | 156/384 X |
| 3,888,725 | 6/1975 | French | 156/344 X |
| 3,953,278 | 4/1976 | Smith | 156/361 |
| 3,984,277 | 10/1976 | French | 156/497 |
| 4,132,583 | 1/1979 | Hodgson | 156/351 |
| 4,255,220 | 3/1981 | Kucheck et al. | 156/542 X |

*Primary Examiner*—David Simmons

*Attorney, Agent, or Firm*—Varnum, Riddering, Schmidt & Howlett

[57] ABSTRACT

A labeling mechanism (10) for sequentially dispensing labels (49) from a backing strip (51) onto articles includes a pair of pinch bars (74) each having a knife edge (76) which bears against the rear edges of the labels (49) and downwardly against the backing strip (51) to move the labels along a pressure plate (66). The pinch bars (74) move in a linear reciprocating manner so as to push the labels (49) and backing strip (51) toward a labeling head (104) which also moves in a reciprocating manner and transfers the labels (49) from the backing strip (51) by means of air suction as the labels are stripped from the backing strip (51) by a knife edge (70). When the articles to be labeled are sensed as being in proper position, a positive air stream is pneumatically directed through the labeling head (104), thereby blowing the labels (49) onto the articles.

14 Claims, 10 Drawing Figures

LABELING MECHANISM

DESCRIPTION

1. Technical Field

The invention relates to label application arrangements and, more particularly, to a labeling mechanism for accurately and sequentially dispensing labels from a label web and applying the labels to articles by means of a pneumatically controlled labeling head.

2. Background Art

Numerous types of label applicator arrangements are available and used in various industries for applying adhesive-backed labels to articles and article packages. These labeling mechanisms attempt to combine high application speeds (i.e. the rate at which labels can be applied to the articles) with accurate positioning of the labels on the articles. Unfortunately, application speed often must be traded for accuracy when designing a label applicator system. Furthermore, high speed and high accuracy mechanisms are often complex, with substantial development and repair costs. Since the cost of the mechanisms must be factored into the manufacturing and packaging costs of the articles, the mechanisms should not be prohibitively expensive.

Many articles are manufactured and packaged in an assembly line operation. Labeling mechanisms for these systems typically include a label web having labels spaced apart and adhesively or otherwise removably attached to a backing strip. A roll of a label-bearing web is mounted on a reel and passed through a device which removes the individual labels from the backing strip and applies them seriatim to the articles, with the "empty" backing strip then wound onto a take-up reel. These mechanisms utilize various types of arrangements for moving the labels into a labeling position, removing the labels from the backing strip and accurately applying them to the articles.

One type of labeling mechanism is disclosed in the U.S. Pat. No. 3,329,550 to Kucheck, issued July 4, 1967. The Kucheck system utilizes a motor-driven take-up reel and a drive roller between the position of label application and the take-up reel to physically move the label web. The unrolled label web is moved around a stripping bar whereby the abrupt change in direction of web movement causes a label to be peeled from the backing strip. The label then moves under a stationary labeling head having a vacuum which holds the label on the underside of the head. The removed label also strikes a microswitch which causes the web driving mechanism to stop web movement. As an article is moved on a separate conveyor under the labeling head, it strikes another microswitch which causes a positive air stream to be applied through perforations in the head, thereby overcoming the vacuum and blowing the label onto the article.

The use of microswitches and alternate starting and stopping of a web driving mechanism in response to microswitch activation somewhat limits the speed of system operation and increases system control complexity. Furthermore, a substantially high pressure air stream must be utilized to overcome the labeling head vacuum. As this air pressure is increased, the accuracy of label application to the article is somewhat decreased.

One problem common to label application arrangements relates to accurate detection of the labels being in position for application. The Kucheck system continuously moves the backing strip until a label has been peeled from the strip and strikes a microswitch on the labeling head. Other systems utilize sensing fingers to detect the presence or absence of labels while on the backing strip and control motor-driven movement of the label web in accordance with label detection. Still other systems, such as those disclosed in the U.S. Pat. No. 3,729,362 to French et al, issued Apr. 24, 1973, utilized photosensing devices to detect label positions and control label web driving mechanisms. Each of these systems utilizes what is basically a two-step process of sensing label position and then controlling the web movement, with distinct mechanisms for each step.

Several of the known labeling mechanisms differ with respect to structure of the labeling head. Like the Kucheck system, many of these labeling heads are stationary and utilize suction/positive air stream arrangements to hold the label after it is "peeled" from the backing strip. The label is then projected onto the article by use of a positive air stream. Other systems, like those disclosed in the U.S. Pat. No. 3,655,492 to Burton, issued Apr. 11, 1972, and U.S. Pat. No. 4,132,583 Hodgson, issued Jan. 2, 1979, utilize labeling heads having a limited movement. The Burton system utilizes a suction head slightly pivotable towards the label backing strip but principally driven vertically as the label is fed horizontally to strip the label from the backing strip. The Hodgson system utilizes a "pressure foot" which can be tilted from its upright position to a position adjacent the area that the label is peeled from a backing strip.

Other labeling heads of known systems differ with repect to their pneumatic suction/positive air stream configurations. For example, the U.S. Pat. No. 3,645,832 to Sauer, issued Feb. 29, 1972, discloses use of a Venturi arrangement to provide suction operations and grid perforations in the head which alternately act as suction and positive air stream ports to hold the label and to project the label onto the article, respectively.

The known label applicator systems make apparent the difficulty of accurately and rapidly dispensing labels adhesively secured to a label backing strip and performing these functions without requiring complex and expensive apparatus. The difficulty in achieving accurate and rapid label application is significantly increased when the labels to be applied are somewhat thin and flimsy, which is often the situation for many commercially packaged articles.

DISCLOSURE OF THE INVENTION

In accordance with the invention, a labeling mechanism for rapidly dispensing labels removably attached to a backing strip and accurately applying each of the labels to different ones of a plurality of articles is of a simple design and structure which advances a label web by exerting forces adjacent a rear edge of at least one of the labels and provides corresponding movement of labeling head means to apply each of the labels without requiring intercommunication between the web advancing means and the labeling head means. The labeling mechanism includes support means and web supply means mounted to the support means for feeding and guiding a label web along a predetermined path. The supply means includes means for at least partially peeling labels seriatim from the backing strip.

The labeling head means is also mounted to the support means along the predetermined path and adjacent to the peeling means. The labeling head means transfers the labels detached from the backing strip by the peeling means to the articles.

The web advancing means is mounted to the support means along the predetermined path and intermittently advances the label web along the path. The web advancing means includes a carriage, a pressure plate secured to the carriage, and a finger pivotably mounted to the carriage over the pressure plate. The advancing means also includes an edge adapted to abut the rear edge of at least one of the labels on the backing strip when it is positioned on the pressure plate. Means are provided to reciprocately move the carriage and pressure plate in unison along the predetermined path. The angle of the finger with respect to the web is such that the finger clamps the web against the pressure plate as it moves in one direction in abutting relationship to the label edge and applies substantially no force as it moves in an opposite direction over the web. Control means are included for synchronizing the reciprocating movement of the carriage and the labeling head means to transfer the labels to articles as they are peeled from the peeling means.

The labeling mechanism also includes a means for reciprocating the labeling head means between the peeling means and the articles. In addition, means are included to join the labeling head means and the web advancing means so that they move in unison. The reciprocating means includes a cylinder means mounted to the support means and having an extendible rod selectively actuable by the control means for providing a reciprocating movement to the web advancing means.

The labeling head means includes a label positioning surface against which a stripped label may rest. Suction means are included to apply a partial vacuum to the surface for holding the label thereon and high pressure air supply means applies a high volume blast of air to the label positioning surface to blow the held label onto the article to be labeled.

The labeling head means also includes a chamber having a central bore extending therethrough. The suction means includes a nozzle and a low pressure air supply means for applying low pressure air through the nozzle into the central bore to expand the air into the bore. The high pressure air supply means includes means for periodically applying a source of high pressure air into the central bore to generate a high volume blast of air and to thereby blow the held label onto the article.

In accordance with the invention, the labeling head means further includes a tube in communication with the central bore of the chamber and at right angles thereto. A distal end of the tube forms the label-positioning surface. The high pressure air supply means includes a nozzle in registry with an end of the tube across the central bore, whereby a blast of high pressure air creates a Venturi effect to increase the volume of air passing through the tube.

In accordance with other concepts of the invention, the labeling mechanism includes biasing means for biasing the finger against the backing strip on the pressure plate so that the backing strip moves with the pressure plate. The biasing means is adjustable to vary the clamping pressure of the finger on the backing strip.

The control means includes a high pressure air supply means for applying a source of high pressure air to a supply line. Means are connected to the supply line and are responsive to the position of the articles to be labeled for applying the high pressure air to the labeling head means. Means connected to the air supply means are responsive to the movement of the web advancing means to lower the pressure of the high pressure air and applying the lower pressure air to the labeling head means. Means connected to the air supply means selectively control movement of the web advancing means and the labeling head means.

A method in accordance with the invention for rapidly dispensing labels removably attached to the backing strip and accurately applying them to different ones of a plurality of articles includes the steps of positioning a label web along a predetermined path which includes a horizontal pressure plate. A vertical force is intermittently exerted to the backing strip in response to contacting the rear edges of the labels with the force applying member. The vertical force is sufficient to clamp the backing strip against the pressure plate. A suction force is applied to a label on the label web while the backing strip is abruptly changing direction of movement. Suction means hold the label after the label is removed from the backing strip and a high pressure air stream is applied to the held label, thereby blowing the label onto the article.

BRIEF DESCRIPTION OF THE DRAWINGS

A preferred embodiment of the invention will now be described with repect to the drawings, in which.

BEST MODE FOR CARRYING OUT THE INVENTION

Figure 1:
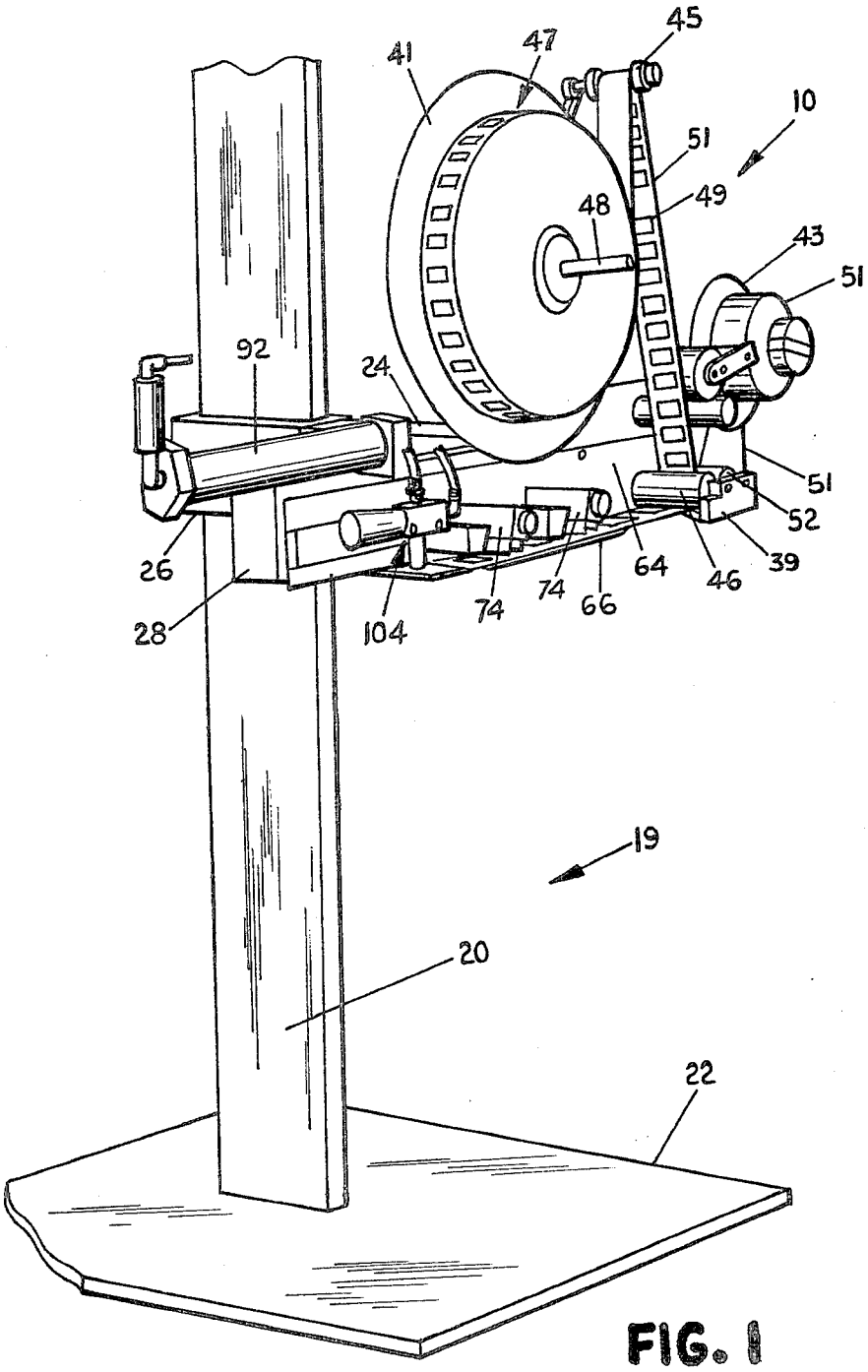
FIG. 1 is a perspective view of a labeling mechanism in accordance with the invention mounted on a support stand.

The principles of the invention are disclosed, by way of example, in a labeling mechanism 10 as depicted in the perspective view of FIG. 1. To position the mechanism 10 at a working height, the mechanism 10 is mounted on a support stand 19 comprising a vertical support 20 secured to and mounted above a horizontal base plate 22 which supports the stand 19 at ground level. A horizontally pivotable member 24 is conventionally secured to the vertical support 20 by means of a coupling 26. A standard mounting plate 28 is rigidly secured to the horizontal member 24, and the member 24 is rotatable about its longitudinal axis relative to the conventional coupling 26. It is apparent that various other types of supporting arrangements can be utilized to position the labeling mechanism 10 at a working height for purposes of label application.

Figure 2:
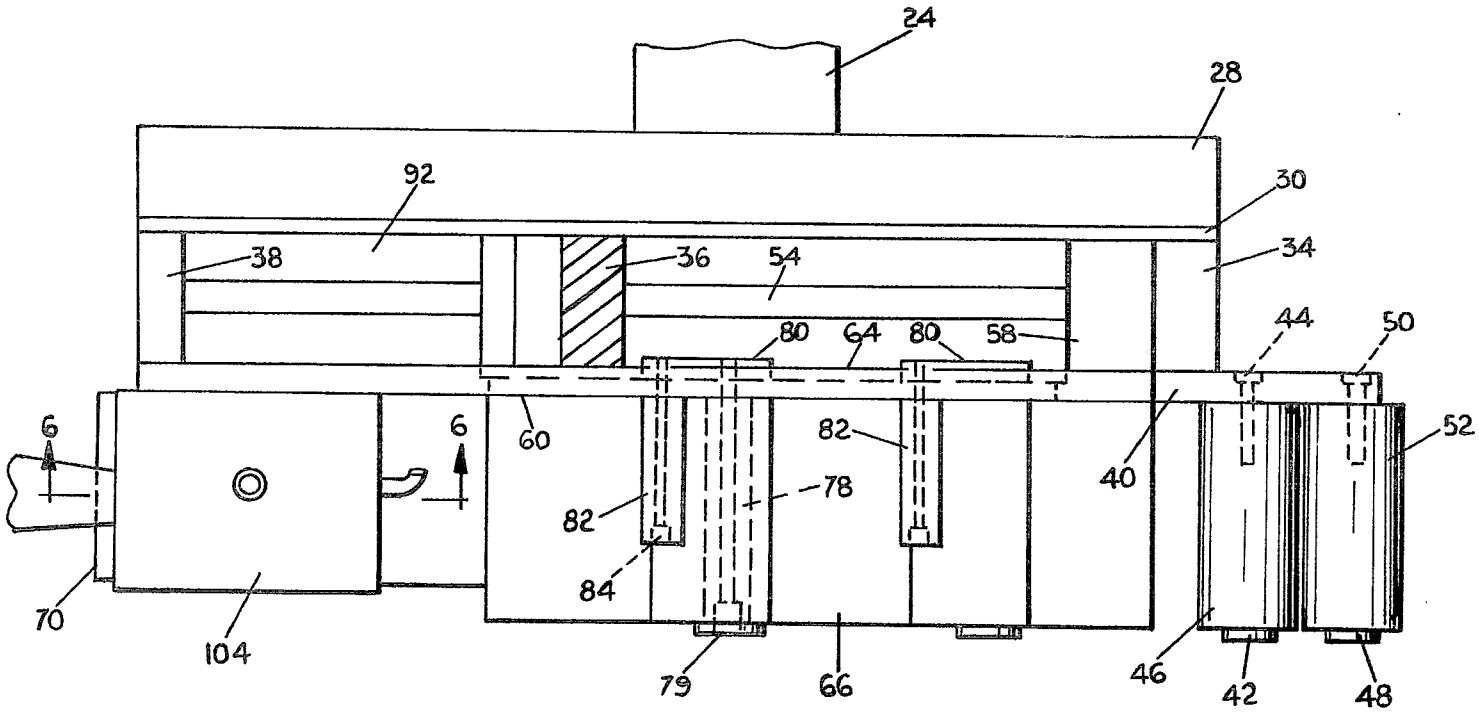
FIG. 2 is a partial plan view of the labeling mechanism depicted in FIG. 1 and seen generally along lines 2—2 of FIG. 3.
Figure 3:
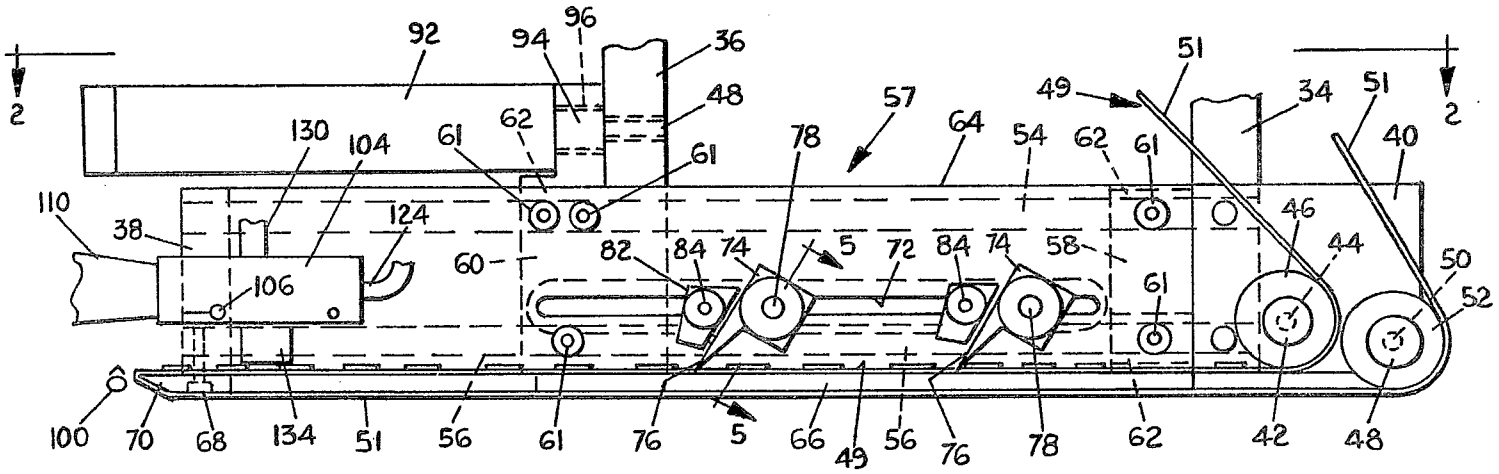
FIG. 3 is a partial front elevational view of the labeling mechanism depicted in FIG. 1.

As depicted in FIGS. 1 and 2, the labeling mechanism 10 is secured to the mounting plate 28 and includes a rigid frame comprising a stationary vertical back plate 30 to which are mounted rigid spacer members 34, 36 and 38. A vertically disposed front mounting plate 40 is secured to the forward positions of the spacer members 34, 36 and 38. As depicted in FIGS. 2 and 3, the front mounting plate 40 is utilized to mount a pair of guide rollers 46 and 52 through use of spindles 42 and 48, respectively. The spindles 42 and 48 are secured to the front mounting plate 40 by means of pins 44 and 50, respectively. A roller support plate 39 can be mounted to the spindles 42 and 48 at the free ends thereof to rigidify the mounting of rollers 46 and 52. Support plate 39 is secured to the mounting plate 40 through conventional means such as screws (not shown).

A reel 41 is rotatably mounted to the spacer member 36 through axle 18. The reel 41 is not shown in FIGS. 2 and 3 for purposes of clarity. Conventionally mounted to the reel 41 is a rolled label web 47 comprising a backing strip 51 with spaced apart labels 49 adhesively or otherwise removably attached to one side of the backing strip 51. The label web is guided through a label path including guide roller 45, guide roller 46, around pressure plate 66, around guide roller 52, around nip roller 53 and tension roller 55 and onto take-up reel 43. Various well-known means can be utilized to mount the label web 47 on the reel 51 or other apparatus for purposes of supplying and feeding the label web 47 into the labeling mechanism. Accordingly, the details of reel 41 and means for mounting the same are not depicted in the drawings.

The guide rollers 46 and 52 are utilized to guide the label web 47 through the labeling mechanism 10 in the manner subsequently described herein. When the labels 49 are removed from the label web 47, the remaining backing strip 51 without the labels 49 is then wound over guide roller 52, nip roller 53, tension roller 55 and onto a take-up reel 43 which is mounted to the spacer member 34. The take-up reel 43 preferably can be motor-driven so as to apply a slight pulling force to the backing strip 51 and thereby assist in winding the strip 51 onto reel 43. Motor-driven take-up reels and means for mounting the reels are well-known in the art of labeling mechanism design. Accordingly, the take-up reel 43 and mounting of the reel 43 to the frame of labeling mechanism 10 is neither depicted in detail nor subsequently described herein. Preferably the nip roller 53 and tension roller 45 apply a constant tension to the web so that a constant force is applied to the web 51 during the intermittent movement of the backing strip web 51. To this end, the tension roller 55 is pivotably mounted on an arm to constantly take up the slack during the intermittent movement of the web. The force of the tension roller 55 on the web 51 is less than the drag on the web 51 from the reel 41.

Figure 4:
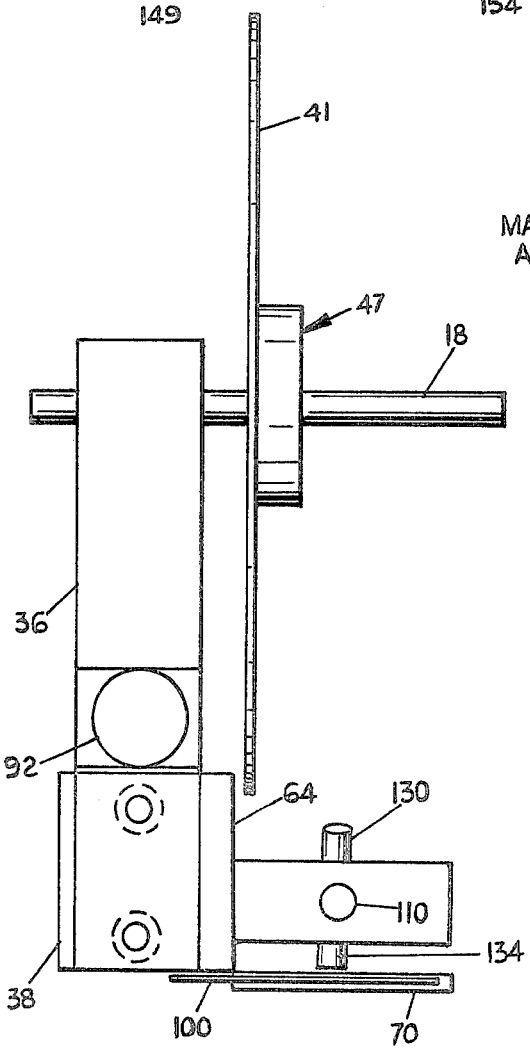
FIG. 4 is an end view of the labeling mechanism depicted in FIG. 1.

As depicted in FIGS. 2–4, a pair of horizontal guide rails 54 and 56, with guide rail 54 disposed directly above rail 56, are fixed at their ends to the spacer members 34 and 38. The rails 54, 56 are utilized to mount a carriage apparatus 57 which is utilized to apply linear reciprocating movement to various elements of the labeling mechanism 10 as subsequently described herein. The carriage 57 comprises a vertical mounting plate 64 secured to a pair of slides 58 and 60 by means of bolts 61 or other suitable connecting means. Ball bearings 62 are mounted in each of the slides 58 and 60 around the guide rails 54 and 56 so as to provide a relatively frictionless sliding movement of the slides 58 and 60 on the rails 54 and 56. The pressure plate 66 is mounted to the mounting plate 64 through bolts (not shown).

Figure 5:
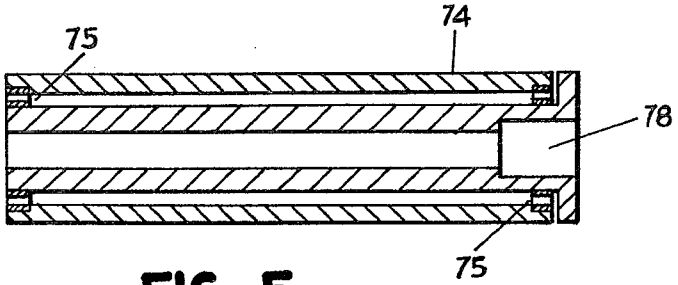
FIG. 5 is a sectional view taken along lines 5—5 of FIG. 3.

As depicted in FIG. 3, the carriage mounting plate 64 includes a horizontal slot 72 for adjustably mounting a pair of pincher bars 74. Each of the pincher bars 74 includes a pointed edge 76 disposed toward a horizontal pressure plate 66. The pincher bars 74 are secured to the carriage mounting plate 64 by means of bolts 78 and vertically disposed clamping plates 80 (FIG. 2) which are rigidly mounted to the rear of the carriage mounting plate 64. The bolts 78 extend through the horizontal slot 72 and are utilized to clamp the pincher bars 74 securely against the carriage mounting plate 64. The bolts 78 threadably engage threaded bores in the clamping plates 80 and the pincher bars 74 are freely rotatable on the bolts through a bearing means 75 as depicted in the sectional view of FIG. 5. In accordance with the foregoing, the pincher bars 74 horizontally move in correspondence with the mounting plate 64.

Figure 3A:
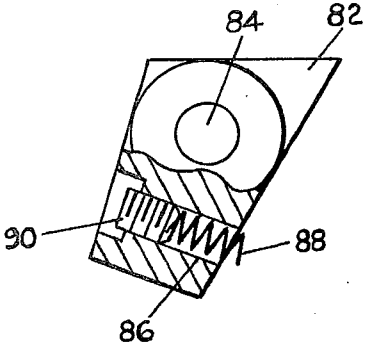
FIG. 3A is an enlarged view of one of the biasing blocks depicted in FIG. 3.

To bias the pincher bars 74 in a position as illustrated in FIG. 3, a pair of corresponding horizontally disposed biasing blocks 82 are utilized. Extending through the biasing blocks 82 are horizontally disposed bolts 84 which also extend through the slot 72 and threadably engage threaded bores in the clamping plates 80. As depicted in the enlarged view of FIG. 3A, each biasing block 82 includes a threaded bore 86 in which is threaded a set screw 90. A conventional spring mechanism 88 is positioned between the end of the set screw 90 and the corresponding pincher bar 74 for purposes of forcing the knife edge 76 against the pressure plate 66. The spring pressure from each of the spring mechanisms 88 is relatively light and adjustable by adjusting the position of the set screw 90 in the threaded bore 86.

As will be subsequently described herein, the knife edges 76 of the pincher bars 74 are utilized to abut the rear edges of labels 49 on the backing strip 51 and to thereby move the label web 47 across the pressure plate 66 to the left as depicted in FIG. 3. The angle of the knife edges 76 with respect to a vertical plane is preferably in the range of 15° to 18°, although the angle can vary from 13° to about 22°. In part, this angle variance will depend upon the thickness of the labels 49. The angle must be high enough so as to move the knife edge over the backing strip without applying a vertical clamping pressure to the backing strip 51 until the label edge is contacted by the knife edge. However, the angle must not be so high so as to push the backing strip along without clamping pressure between the knife edges 76 and the pressure plate 66. This system provides for indexing of the labels with respect to the labeling head 104.

As depicted in FIG. 3, a stationary knife edge plate 70 is mounted to the spacer member 38 by means of a bolt 68. The knife edge plate 70 is conventional in design and is utilized to partially strip each of the labels 49 from the backing strip 51 by abruptly changing the directional path of label web 47 around the knife plate 70. As more specifically described subsequently herein with repect to the pneumatic components of the labeling mechanism 10, an air assist tube 100 is provided adjacent to the knife edge plate 70. The air assist tube 100 includes small holes (not shown) in the upper side thereof and is connected to a supply of low pressure air as subsequently described herein to project an air stream upwardly against each of the labels 49 as they are being stripped from the backing strip 51. The purpose of the air assist tube 100 is to assist in pushing each of the labels 49 up against a labeling head 104 subsequently described herein.

As further depicted in FIG. 3, a conventional pneumatic air cylinder 92 is mounted to an upper portion of the slide 60. The cylinder 92 has an extendable piston rod 94 which extends through an opening 96 in the upper portion of slide 60. The rod 94 is threaded at its end opposite to cylinder 92 and threadably engages an opening 96 in the spacer member 36. In accordance with the foregoing, actuation of the cylinder (when initially in a closed position) will cause the rod 94 to be extended. With the cylinder 92 mounted to the slide 60, this extension will cause forces to be applied to slide 60, which correspondingly will move horizontally along the guide rails 54 and 56. Movement of slide 60 will cause corresponding movement of the elements of carriage 57 previously described herein.

As further depicted in FIG. 3, labeling mechanism 10 includes a labeling head 104 which provides a means for in part stripping each of the labels 49 from the backing strip 51, holding the stripped labels 49, and applying the labels 49 to the articles when the articles are in proper position. The labeling head 104 is secured to the carriage mounting plate 64 through bolts 106 or other suitable connecting means. Accordingly, the head 104 moves in correspondence to the pincher bars 74 and other elements of carriage 57 as previously described herein. When the cylinder 92 is in the closed position as illustrated in FIG. 3, the head 104 rides above the knife edge plate 70 and, with pneumatic procedures as subsequently described herein, strips each of the labels 49 from the backing strip 51 as they are projected from the strip 51 by the abrupt directional path change around knife plate 70. As the cylinder 92 is actuated, the labeling head moves to the left as illustrated in FIG. 3 and "blows" each of the labels 49 onto the articles when they are positioned therebeneath.

Figure 6:
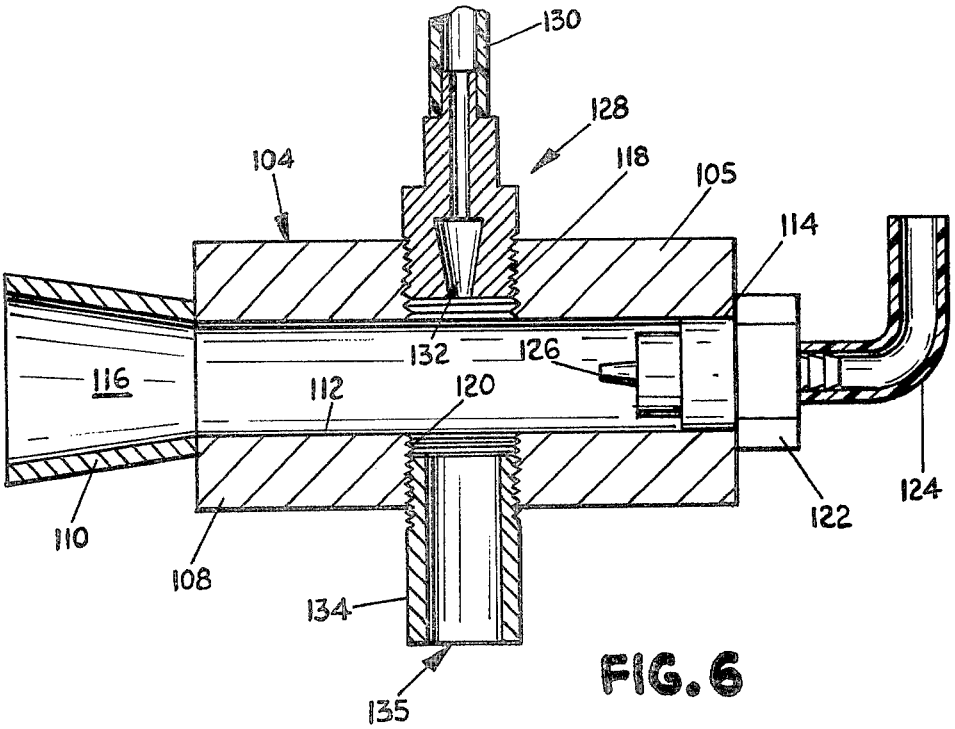
FIG. 6 is a sectional view taken along lines 6—6 of FIG. 2.

As depicted in FIG. 6, the labeling head 104 includes a housing chamber 105 having an outlet nozzle 110 mounted within an expanding outlet bore 116. A central horizontal bore 112 laterally extends through the chamber 105 and is centered with an inlet opening 114 on the side opposite to nozzle 110. The expanding outlet bore 116 is centered with bore 112. At the upper portion of the housing chamber 105, a threaded vertical inlet bore 118 provides a passage into the horizontal bore 112 in registry with and diametrically opposed to a lower threaded vertical outlet bore 120.

An air hose fitting 122 having an outlet nozzle 126 is threaded into the inlet opening 114 and an external low pressure supply hose 124 is connected thereto. An additional air hose fitting 128 having an outlet nozzle 132 is similarly threaded into the vertical inlet bore 118, with a high pressure air hose 130 externally connected thereto. A vertically disposed tube 134 having an opening 135 at its lower end threadably engages the lower vertical outlet bore 120.

In operation of the labeling head 104 as illustrated in FIG. 6, low pressure air is externally supplied through the air supply hose 124 to the outlet nozzle 126 and into the central bore 112. The low pressure air is then forced out of the expanding outlet bore 116 which a Venturi-type chamber within bore 112, thereby provides a low pressure suction to the outlet opening 135 of tube 134. Accordingly, as the label head 104 and tube 134 move across the knife edge plate 70, suction in the tube 134 pulls the labels 49 and strips them from the backing strip 51.

High pressure air is externally supplied to the air supply hose 130 but only at selected intervals. During the periods of time that labels 49 are being stripped from the backing strip 51, high pressure air is not supplied. However, when the tube 134 is positioned over the article to be labeled, high pressure air is supplied through hose 130 and through outlet nozzle 132 to the vertical tube 134. The high pressure air supply will create a Venturi-type effect within bore 112 as the air expands into the tube 134. The effect of this expanded high pressure air will cause air to be drawn in through the expanding outlet bore 116 and through the tube 134, thereby creating a high volume blast of air to blow the label off the tube 134 and onto the article to be labeled.

Figure 7:
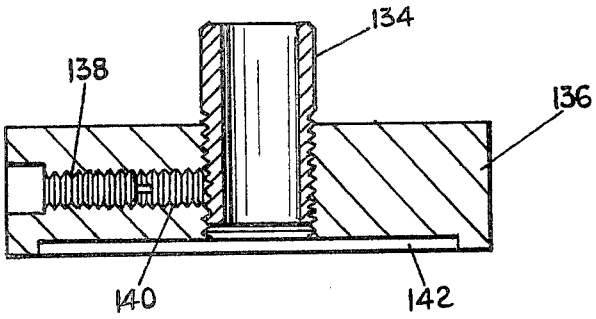
FIG. 7 is a partial sectional view similar to FIG. 6 and showing an addition to the labeling head to accomodate larger labels.
Figure 8:
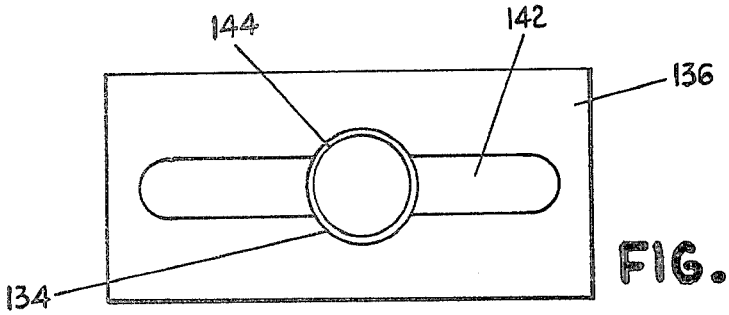
FIG. 8 is a sectional view taken along lines 8—8 of FIG. 7.

The size of the labels 49 which can be utilized with the labeling head 104 as depicted in FIG. 6 is limited in part by the cross-sectional area of the opening 135 in vertical tube 134. That is, if the labels 49 are of substantially larger cross-sectional area than opening 135, the air suction provided by such opening will be insufficient to hold the label and the label cannot accurately be "blown" onto the article to be labeled. However, for such labels, an expander head 136 can be attached to the tube 134 by means of fitting the tube 134 into a central bore 144 as depicted in FIGS. 7 and 8. The expander head 136 includes a lateral threaded bore 138 having a threaded set screw 140. The position of the vertical tube 134 in the bore 144 can thus be fixed and secured by the set screw 140. An elongated slot 142 is formed in the lower portion of the expander head 136 in communication with bore 144 and, accordingly, in communication with tube 134. Therefore, any vacuum or positive air stream in the tube 134 is spread along the entire cross-sectional area of the slot 142 to accomodate larger labels.

Figure 9:
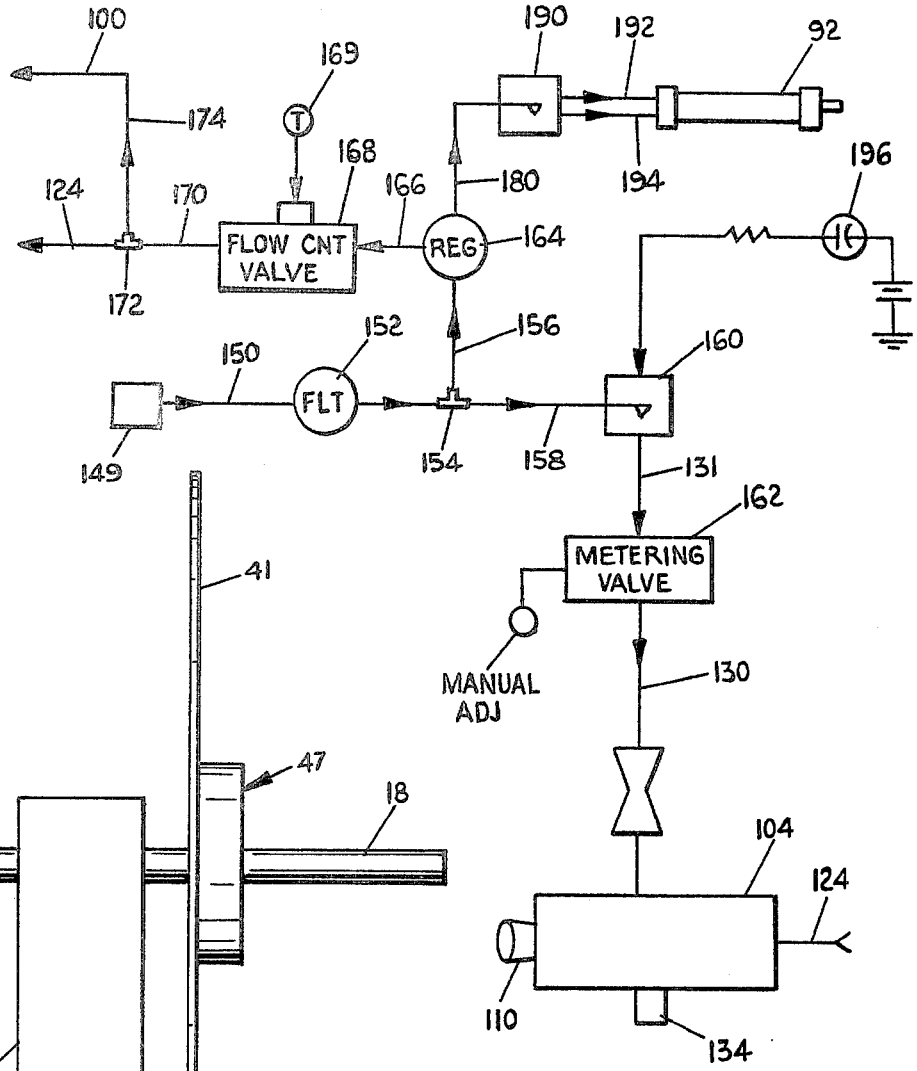
FIG. 9 is a schematic representation of a pneumatic control system used in the labeling mechanism in accordance with the invention.

As apparent from the foregoing description, several components of the labeling mechanism 10 operate under principles of pneumatic control. FIG. 9 is a schematic representation of a pneumatic control arrangement for labeling mechanism 10 in accordance with the invention. Various mechanical elements of mechanism 10 previously described herein are represented symbolically in FIG. 9. As depicted in FIG. 9, high pressure air is supplied from a pneumatic supply source 149 through air supply hose 150. The high pressure air is passed through a filter 152 into a conventional T-connection 154. A portion of the high pressure air is thereafter directed through a line 158 to a solenoid-operated valve 160 which controls air flow therethrough. The solenoid-operated valve 160 is controlled by means such as photosensor 196 or other suitable means to sense the existence and position of the article to be labeled beneath the labeling head 104. Neither the photosensor 196 nor the articles to be labeled are depicted in the other drawings or otherwise described herein. Photosensing devices to detect article position and means such as conveyor apparatus for sequentially transporting the articles to be labeled beneath the labeling mechanism 10 are well-known in the art of label application design.

Under control of the solenoid-operated valve 160, air flow through line 158 is directed to high pressure air line 131. A manually adjustable metering valve 162 controls the air flow rate in line 131. The air from line 131 is thereafter applied to air hose 130 as a high pressure source of air for labeling head 104 as previously described with respect to FIG. 6. The valve 162 provides a means for controlling the air flow into hose 130.

From T-connection 154, high pressure air is passed through the air hose 156 and directed through regulator 164 which controls and smooths the rate of air flow. The regulator 164 directs air through line 166 into flow control valve 168 and into a T-connection 172 by means of line 170. A portion of the air supplied to T-connection 172 is directed into air supply line 124 previously described with respect to FIG. 6. The other portion of the air supplied to T-connection 172 is directed through line 174 into air assist tube 100 previously described with respect to FIG. 3. The flow control valve 168 functions so as to allow a relatively high flow rate through the valve to generate a relatively high vacuum in the labeling head 104 and, accordingly, to generate a significant flow of air through the air assist tube 100.

At the commencement of an air cycle, the flow control valve 168 is opened simultaneously when the carriage mounting plate 64 starts a forward motion. To achieve this function, a timer 169 which is made to operate a predetermined time after actuation of cylinder 92 can be utilized to actuate the flow control valve 168. Also, other conventional and well-known means can be utilized to detect movement of mounting plate 64 and to correspondingly actuate valve 168. At the end of the forward motion cycle, by means such as the timer 169, the flow control valve 168 is shut down to allow only a small volume of air to pass through valve 168 and thus through the hoses 124 and 174. During this time duration, there is a low vacuum generated in labeling head 104 and in the threaded tube 134.

By means of a high pressure outlet from regulator 164, high pressure air is supplied to the solenoid-operated valve 190 through a line 180. The outlets from the solenoid-operated valve 190 are connected to different ends of the cylinder 92 (previously described with respect to FIG. 3) through air lines 192 and 194. Accordingly, in operation, the high pressure air passing through the regulator 164 and into the solenoid-operated valve 190 continuously supplies air to one end of the air cylinder 92. When the valve 190 is switched by means of photosensor 196, high pressure air is supplied to the other end of the cylinder 92 and the air in the first end of the cylinder 92 is exhausted in a conventional manner.

As previously described, the solenoid operated valves 160 and 190 are responsive to sensing of an article beneath the labeling head 104. For example, the article beneath the labeling head 104 can be sensed by means of the photo sensor 196 or other conventional detecting means. When the article is sensed, the solenoid operated valve 160 is actuated to deliver high pressure air through the line 131 and hose 130 to labeling head 104 and thereby drive the label 49 from the threaded tube 134 onto the article. As apparent from the foregoing description, electrical circuitry can be utilized to provide control of various elements of the labeling mechanism. However, many different types of electrical control configurations could be utilized and no specific configuration is described herein. Suitable electrical configurations will be apparent to those having knowledge of the labeling mechanism 10 described herein and skill in the art of control system design.

The complete operation of the labeling mechanism 10 will now be described with reference to FIGS. 1-9.

The labeling mechanism 10 is mounted on the support stand 19 with articles (not shown) arranged so as to sequentially pass beneath the labeling head 104. The articles can be transported in any suitable manner such as by conveyor means. As apparent from the subsequent operational description herein, the labeling mechanism 10 is not substantially complex in design or operation. Accordingly, initial purchase and subsequent maintenance/repair costs are not prohibitively expensive.

The label web 47 having labels 49 removably attached to a backing strip 51 is mounted on a reel 41 with the web 47 threaded around guide roller 44, along the upper horizontal surface of pressure plate 44, around the knife edge plate 70, along the lower surface of pressure plate 44, around guide roller 52 and onto take-up reel 43. Take-up reel 43 is motor-driven so as to apply a slight pulling force to the label web 47.

When the solenoid-operated valve 190 is switched from its state in which cylinder 92 tends to remain in a closed position as shown in FIG. 3, the cylinder 92 is actuated and the cylinder rod 94 is extended, thereby applying forces to the slide 60 on which cylinder 92 is mounted. Cylinder actuation thus tends to move the carriage 57 and the labeling head 104 to the left as viewed in FIG. 3. The pinch bars 74 correspondingly move to the left and the knife edges 76 abut the rear edges of labels 49 while applying a slight downward pressure to the backing strip 51 on the pressure plate 66 to pinch or clamp the backing strip 51 to the pressure plate. Accordingly, the label web 47 is clamped to the pressure plate 66 and moves therewith. The use of two pinch bars 74 provides for the possible occurrence of a missing label 49. Furthermore, with the labels 49 moved through a distance which is determined by the horizontal travel of pinch bars 74 and pressure plate 66, the indexing of the labels 49 to the labeling head 104 is automatically obtained. Accordingly, no sensing apparatus is necessary to sense position of the labels 49 while on the label web 47.

As previously described herein, the flow-control valve 168 is opened simultaneously with the limitation of the movement of the carriage mounting plate 64 is initiated. Opening of valve 168 causes low pressure air to be supplied through hose 124 into the labeling head 104. As previously described herein, a suction is thereby created in the vertical tube 134. In addition, air is correspondingly being supplied to air assist tube 100. With the labeling head 104 moving to the left as viewed in FIG. 3, the air assist tube aids in stripping the particular label 49 which is being stripped in part from backing strip 51 by the abrupt change in direction around knife edge plate 70. Simultaneously, the suction from vertical tube 134 also assists in removing the label 49 from the backing strip 51 and causes the label 49 to be secured to the lower opening 135 of tube 134.

When an article to be labeled is detected by photosensor 196 as being in a correct position for label application, the solenoid-operated valve 160 is switched to a state which allows high pressure air to be supplied to labeling head 104 by means of air hose 130. At this time, a label 49 has been completely stripped from the backing strip 51 and is secured to vertical tube 134. As previously described herein, the high pressure air will cause a "blast" (high flow rate positive air stream) of air to be applied through tube 134, thereby "blowing" the label onto the article to be packaged.

As the cylinder 92 reaches the end of its "forward" motion cycle (to the left as viewed in FIG. 3), flow control valve 168 is switched and a low vacuum is generated in labeling head 104. Solenoid-operated valve 190 is also switched and the cylinder 92 is deactivated, thus causing the extendible rod 94 to be retracted and the carriage 57, with the labeling head 104 and pinch bars 74, to move to the right as viewed in FIG. 3 (FIG. 3 actually shows the rightmost position of carriage 57).

With the pinch bars 74 biased by biasing blocks 84, and with the knife edges 76 angled as depicted in FIG. 3, the pinch bars 74 will ride over the labels 49 with the pressure plate 66 during the return segment of their reciprocating cycle. The aforedescribed functions are repeated to sequentially apply the labels 49 to the articles.

It is apparent from the foregoing description that separate and sequential sensing devices are unnecessary in the labeling mechanism 10. That is, the labeling head 104 which applies the labels 49 to the articles to be labeled moves in correspondence with the pinch bars 74 which exert forces against label web 47 to move the labels 49 into position for application to the articles. Accordingly, it is unnecessary to first detect label position on a web, then apply a sensing signal to separate and distinct devices to move the label web toward a label applicator, and finally apply additional sensing signals to a separately moved label applicator device so as to apply the label. The labeling mechanism 10 in accordance with the invention utilizes position sensing only of the articles to be labeled. Furthermore, with the labeling head 104 moving in correspondence with pinch bars 74 by means of cylinder 92, no communication signals (with their inherent speed limitation and increased control complexity) must be applied between the labeling means (head 104) and the means to move the label web (pinch bars 74).

It should be noted that many of the particular mechanical assemblies and connection arrangements described herein are not meant to be an exhaustive enumeration of the particular structures which can be utilized with a labeling mechanism in accordance with the invention. Accordingly, it will be apparent to those skilled in the pertinent art that modifications and variations of the above-described illustrative embodiments of the invention can be effected without departing from the spirit and scope of the novel concepts of the invention.

The embodiments of the invention in which an exclusive property or privilege is claimed are defined as follows:

1. A labeling mechanism for rapidly dispensing labels which are removably attached to a backing strip, and for accurately applying each of the labels to different ones of a plurality of articles, the labeling mechanism comprising:

support means;

web supply means mounted to the support means for feeding and guiding a lable web along a predetermined path, said web supply means including means for at least partially peeling labels seriatim from the backing strip;

labeling head means mounted to the support means along the predetermined path and adjacent the peeling means for transferring the labels from the backing strip to the articles;

web advancing means mounted to the support means along the predetermined path for intermittently advancing the label web along the predetermined path, the web advancing means comprising a carriage, a pressure plate secured to the carriage and providing a surface over which the label web passes, and a finger pivotably mounted to the carriage over the pressure plate, the finger having an edge adapted to abut the rear edge of at least one of the labels on the backing strip when the label containing-backing strip is positioned on the surface of the pressure plate, and means to reciprocably move the carriage and pressure plate in unison along the predetermined path, the angle of the finger with respect to the web being such that the finger clamps the web against the pressure plate as the finger moves in one direction in abutting relationship to the label edge and applies substantially no clamping forces as the finger moves in an opposite direction; and control means for synchronizing the reciprocating movement of the carriage and the labeling head means to transfer labels to articles as they are peeled from the peeling means.

2. A labeling mechanism according to claim 1 and further comprising means for reciprocating the labeling head means between the peeling means and the articles.

3. A labeling mechanism according to claim 2 and further comprising means joining the labeling head means and the web advancing means so that they move in unison.

4. A labeling mechanism according to claim 3 wherein the reciprocating means comprises a cylinder means mounted to the support means, the cylinder means including an extendible rod and being selectively actuable by the control means for providing a reciprocating movement to the web advancing means.

5. A labeling mechanism according to claim 1 wherein the labeling head means comprises:

a label positioning surface against which a stripped label may rest;

suction means for applying a partial vacuum to the surface for holding the label thereon;

high-pressure air supply means for applying a high-volume blast of air to the label-positioning surface to blow the held label onto the article to be labeled.

6. A labeling mechanism according to claim 5 characterized in that:

the labeling head means comprises a chamber having a central bore extending therethrough;

the suction means comprises a nozzle and a low-pressure air supply means for applying low-pressure air through a nozzle into the central bore to expand the low-pressure air into the central bore; and the high-pressure air supply means comprises means for periodically applying a source of high-pressure air into the central bore to generate a high-volume blast of air to blow the held label onto the article.

7. A labeling mechanism according to claim 6 wherein the labeling head means further comprises a tube in communication with the central bore of the chamber and at right angles thereto, a distal end of the tube forming the label-positioning surface.

8. A labeling mechanism according to claim 7 wherein the high-pressure air supply means includes a nozzle in registry with an end of the tube across the central bore, whereby a blast of high-pressure air creates a Venturi effect to increase the volume of air passing through the tube.

9. A labeling mechanism according to claim 1 wherein the labeling mechanism further comprises biasing means for biasing the finger against the backing strip on the pressure plate while allowing the pressure plate to move relative to the backing strip in the opposite direction.

10. A labeling mechanism according to claim 9 wherein the biasing means is adjustable to vary the clamping pressure of the finger on the backing strip.

11. A labeling mechanism according to claim 1 wherein the control means comprises;

high-pressure air supply means for applying a source of high-pressure air to a supply line;

means connected to the air supply line and responsive to the position of the articles to be labeled for applying the high-pressure air to the labeling head means;

means connected to the air supply means and responsive to the movement of the web advancing means for lowering the pressure of the high-pressure air and applying the lower-pressure air to the labeling head means; and means connected to the air supply means for selectively controlling movement of the web advancing means and the labeling head means.

12. A method for rapidly dispensing labels which are removably attached to a backing strip, and for accurately applying each of the labels to different ones of a plurality of articles, the method comprising the steps of:

positioning a label web along a predetermined path which includes a horizontal pressure plate;

intermittently exerting a vertical force to the backing strip in response to contacting the rear edges of the labels with a force applying member, the force being sufficient to clamp the backing strip against the pressure plate;

applying a suction force to a label on the label web while the backing strip is abruptly changing direction of movement;

holding the label by suction means after the label is removed from the backing strip; and applying a high pressure air stream to the held label, thereby blowing the label onto the article.

13. A labeling mechanism for rapidly dispensing labels which are removably attached to a backing strip, and for accurately applying each of the labels to different ones of a plurality of articles, the labeling mechanism comprising:

support means;

web supply means mounted to the support means for feeding and guiding a label web along a predetermined path, said web supply means including means for at least partially peeling labels seriatim from the backing strip and a pressure plate over which the label web passes;

labeling head means mounted to the support means along the predetermined path and adjacent the peeling means for transferring the labels from the backing strip to the articles;

web advancing means mounted to the support means along the predetermined path for intermittently advancing the label web along the predetermined path, the web advancing means comprising a carriage and a finger pivotably mounted to the carriage over the pressure plate, the finger having an edge adapted to abut the labels or the backing strip, and means to reciprocably move the carriage along the predetermined path, the angle of the finger with respect to the web being such that the finger applies both vertical forces to the label web or labels as the finger moves in one direction to advance the label web, and applies substantially no forces to the label web or labels as the finger moves in an opposite direction;

control means for synchronizing the reciprocating movement of the carriage and the labeling head means to transfer labels to articles as they are peeled from the peeling means;

means for reciprocating the labeling head means between the peeling means and the articles; and means joining the labeling head means and the web advancing means so that they move in unison.

14. A labeling mechanism according to claim 13 wherein the reciprocating means comprises a cylinder means mounted to the support means, the cylinder means including an extendible rod and being selectively actuable by the control means for providing a reciprocating movement to the web advancing means.

* * * * *